US010816186B2

(12) United States Patent
Jiang

(10) Patent No.: US 10,816,186 B2
(45) Date of Patent: Oct. 27, 2020

(54) THERMAL SYSTEM FOR A STAGE LIGHT SOURCE MODULE

(71) Applicant: Guangzhou Haoyang Electronic Co., Ltd., Guangzhou (CN)

(72) Inventor: Weikai Jiang, Guangzhou (CN)

(73) Assignee: Guangzhou Haoyang Electronic Co., Ltd. (CN)

( * ) Notice: Subject to any disclaimer, the term of this patent is extended or adjusted under 35 U.S.C. 154(b) by 165 days.

(21) Appl. No.: 15/997,114

(22) Filed: Jun. 4, 2018

(65) Prior Publication Data

US 2018/0283675 A1 Oct. 4, 2018

Related U.S. Application Data

(63) Continuation of application No. PCT/CN2016/098237, filed on Sep. 6, 2016.

(30) Foreign Application Priority Data

Dec. 3, 2015 (CN) ..... 2015 1 0880533

(51) Int. Cl.

| | |
|---|---|
| ***F21V 29/67*** | (2015.01) |
| ***F21V 29/60*** | (2015.01) |
| ***F21W 131/406*** | (2006.01) |
| ***F21V 5/00*** | (2018.01) |

(52) U.S. Cl.

CPC ..... *F21V 29/673* (2015.01); *F21V 29/60* (2015.01); *F21V 5/00* (2013.01); *F21W 2131/406* (2013.01)

(58) Field of Classification Search

CPC ..... F21V 29/673; F21V 29/60; F21V 29/67; F21V 29/677; F21V 29/507; F21V 29/505

See application file for complete search history.

(56) References Cited

U.S. PATENT DOCUMENTS 7,210,825 B2 * 5/2007 Watanabe ..... H04N 9/315 362/373
7,350,926 B2 * 4/2008 Fukuda ..... H04N 9/3144 353/55

(Continued)

FOREIGN PATENT DOCUMENTS

CN 103307581 A * 9/2013
CN 103307581 A 9/2013

(Continued)

OTHER PUBLICATIONS

Jiang, Stage lamp thermal system, Sep. 18, 2013, CN103307581, English (Year: 2013).*

(Continued)

*Primary Examiner* — Bryon T Gyllstrom
*Assistant Examiner* — James M Endo
(74) *Attorney, Agent, or Firm* — Lerner, David, Littenberg, Krumholz & Mentlik, LLP

(57) ABSTRACT

A thermal system for a stage light source module, including a lamp chamber for accommodating a light source and a light condenser arranged in the lamp chamber, wherein the lamp chamber is of a hollow columnar or cylindrical or cylindroid structure defined by at least five side walls. The system is simple and convenient to use, can increase the safety and stability of a lamp, and can prolong the service life of a stage lamp system.

10 Claims, 2 Drawing Sheets

(56) References Cited

U.S. PATENT DOCUMENTS

| | | | | |
|---|---|---|---|---|
| 7,594,739 | B2 * | 9/2009 | Taguchi | G03B 21/16 362/261 |
| 7,891,846 | B2 * | 2/2011 | Noda | H04N 9/3144 362/373 |
| 2001/0030865 | A1 * | 10/2001 | Glowach, Sr. | F21V 29/67 362/294 |
| 2004/0017686 | A1 * | 1/2004 | Dedoro | F21V 29/02 362/373 |
| 2004/0145896 | A1 | 7/2004 | Watanabe et al. | |
| 2007/0132353 | A1 * | 6/2007 | Gijzen | G03B 21/16 313/113 |
| 2007/0216874 | A1 * | 9/2007 | Suzuki | G03B 21/16 353/57 |
| 2009/0237619 | A1 * | 9/2009 | Yanagisawa | G03B 21/16 353/54 |
| 2011/0032491 | A1 * | 2/2011 | Tsai | F21V 29/02 353/61 |
| 2011/0249443 | A1 * | 10/2011 | Jurik | F21V 3/02 362/294 |
| 2013/0155688 | A1 * | 6/2013 | LaVigna | F21V 21/00 362/311.01 |

FOREIGN PATENT DOCUMENTS

| | | | |
|---|---|---|---|
| CN | 203336551 | U | 12/2013 |
| CN | 203413595 | U | 1/2014 |
| CN | 203442758 | U | 2/2014 |
| CN | 203454073 | U | 2/2014 |
| CN | 204201834 | U | 3/2015 |
| CN | 204285393 | U | 4/2015 |
| CN | 204554514 | U | 8/2015 |
| CN | 105333408 | A | 2/2016 |
| CN | 205227241 | U | 5/2016 |

OTHER PUBLICATIONS

International Search Report for PCT/CN2016/098237 (WO2017/092464) dated Dec. 7, 2016.

* cited by examiner

THERMAL SYSTEM FOR A STAGE LIGHT SOURCE MODULE

CROSS REFERENCE TO RELATED APPLICATIONS

The present application is a continuation of International Application No. PCT/CN2016/098237, filed Sep. 6, 2016, which claims priority from Chinese Patent Application No. 201510880533.8 filed Dec. 3, 2015, all of which are hereby incorporated herein by reference.

TECHNICAL FIELD

The present invention relates to the technical field of stage lighting fixtures, and in particular to a thermal system for a stage light source module.

BACKGROUND ART

The power of a light source of a special stage lighting fixture is generally relatively high, for example, when a traditional light source such as a high voltage arc lamp is in operation, the temperature of the arc lamp center is very high (about 8000 □), even a light bulb with a relatively lower temperature has a temperature of nearly 1000 □ on the surface. Under such high-temperature conditions, a large quantity of heat will be generated, and the heat will cause irreversible damage to the light source if it is not dissipated in time. Further, the light source also has certain requirements for the operating temperature when in use, and excessively high temperature can result in a series of problems on the light source, such as efficiency reduction of light source, thermal erosion damage to the electronic components, or burst of the bulb; and if the temperature of the light source is too low, it can also cause problems such as whitening and failure of the light bulb. Therefore, not only the excess heat needs to be dissipated, but also the temperature needs to be controlled within a reasonable range, which puts a high demand on the thermal configuration of the stage light source module.

In prior art, the thermal system for a stage light source module generally includes a light source, a lamp chamber, a heat-shield assembly, a first blower assembly for cooling the lamp chamber and the light source, and a second blower assembly for cooling a lighting system. The lamp chamber includes a cover plate, side walls, and an air outlet assembly, and the light source is installed therein. A cross section of the lamp chamber is in a square or rectangular shape, and adjacent side walls define a right angle. The second blower assembly is installed on a flat surface of a side wall, and air flow generated by the second blower assembly spreads along the flat surface after being prevented by the flat surface, so that components installed perpendicular to the flat surface cannot be cooled, which is detrimental to stability of the lighting system.

SUMMARY OF INVENTION

It is therefore an object of the present invention to provide a thermal system for a stage light source module free from at least one of the aforesaid drawbacks of the prior art, which is simple in structure and convenient to use, and can improve the safety and stability of the stage lighting fixtures and prolong the service life of the stage lighting system.

According to the present invention, a thermal system for a stage light source module is provided including a lamp chamber for housing a light source; and a light condenser which is provided in the lamp chamber and through which light emitted from the light source is converged into a light beam defining a main optical axis. The lamp chamber is of a hollow columnar structure defined by at least five side walls, or of a hollow cylindrical structure, or of a hollow elliptic cylindrical structure. In theory, there can be an unlimited number of side walls, but generally the number of side walls is preferably 6 to 100, and more preferably, the lamp chamber is of a hollow columnar structure defined by 6 to 10 side walls. Such design is configured so that good cooling effect can be obtained and meet the requirements without impacting installation of other components, as the hollow column with six to ten side walls is simple in structure and manufacturing process configuration.

Further, a support plate is provided above the lamp chamber, above which a heat-shield assembly is arranged in form of a rectangular box with an opening at the bottom side thereof and defining a heat dissipation chamber together with the support plate; wherein the support plate is provided with a first through hole which is closely fitted to the opening at an end of the light condenser. The thermal system further includes a first air blowing device. An air outlet of the first air blowing device is connected to the heat dissipation chamber and faces the light condenser, so that forcing air flow blown from the first air blowing device spreads to the inside of light condenser, thus cooling the inside of the light condenser and the light source. The support plate is further provided with a second through hole through which the lamp chamber is connected to the heat dissipation chamber. After the forcing air flow, i.e. cold air, from the first air blowing device is blown into the heat dissipation chamber and spreads to the inside of the light condenser and the light source, the cold air becomes heat air, the heat air enters the inside of the lamp chamber through the second through hole and spreads to the outside of the light condenser to cool the outside of the light condenser, and finally the heat air is discharged from the bottom of the lamp chamber. The first through hole and the second through hole can be connected or independent from each other.

Further, the first air blowing device is provided below the support plate, and the support plate is provided with a third through hole through which at least a part of components of the first air blowing device passes.

Further, the heat-shield assembly includes a heat-shield frame and a filter provided on the heat-shield frame and inclined with respect to the main optical axis at an angle within the range of 0-90°. With such a configuration, only a small part of light is reflected back to the light source by the filter when the light passes through the filter, which contributes to the heat dissipation of the light source.

Further, a second air blowing device is provided outside the lamp chamber, and the second blowing device is provided with an air-guiding member which is connected to the lamp chamber through a fourth through hole provided in a side wall of the lamp chamber. An air outlet of the air-guiding member faces the outside of the light condenser, so that air flow blown from the second air blowing device joins the air flow which enters the lamp chamber from the heat dissipation chamber, and spread around the light condenser, thus cooling the outside of the light condenser.

Further, the thermal system further includes a support frame, and the lamp chamber is fixed inside the support frame. An air outlet in the form of blinds is provided at a lower end of the lamp chamber, and the forcing air flow blown into the lamp chamber by the first air blowing device and the second air blowing device is discharged from the air outlet in the form of blinds at the lower end of the lamp chamber. A third air blowing device is provided on the support frame, and the air-out direction of the third air blowing device is directed to the upper part of the lamp chamber. The air outlet of the third air blowing device faces an edge of the hollow column of the lamp chamber, and an angle between the surface of the air outlet of the third air blowing device and the main optical axis is formed in a range from 10° to 60°. With such configuration, the forcing air flow generated by the third air blowing device spreads along two side walls defining the edge so as to mainly cool the components around the light source module, and meanwhile components above the light source in a direction of the main optical axis can also be cooled.

Further, the thermal system further includes a fourth air blowing device provided on an opposite side of the third air blowing device with respect to the lamp chamber. An air outlet of the fourth air blowing device faces another edge of the hollow column of the lamp chamber, and an angle between the surface of the air outlet of the fourth air blowing device and the main optical axis is formed in a range from 10° to 60°. Similarly, such design is configured that the forcing air flow generated by the fourth air blowing device spreads along two side walls defining the edge so as to mainly cool the components around the light source module, and meanwhile the components above the light source in a direction of the main optical axis can also be cooled.

Compared with prior art, there are some beneficial effects according to the present invention.

On one hand, the excess heat generated by the light source module can be removed subtly by optimizing air flow paths of the first air blowing device and the second air blowing device; and on the other hand, the shape change of the lamp chamber and installation directions change of the third air blowing device and the fourth air blowing device, particularly when they cooperate mutually, allow a good cooling effect of both components around the light source module and components installed above the light source, so that the excess heat inside the entire lighting system is discharged and a stable and balanced thermal state can be achieved inside the lighting fixtures, which improves the safety and stability of the lighting fixtures, prolongs the service life of the lighting system, reduces the number of fans used, and reduces the costs.

DETAILED DESCRIPTION

Figure 1:
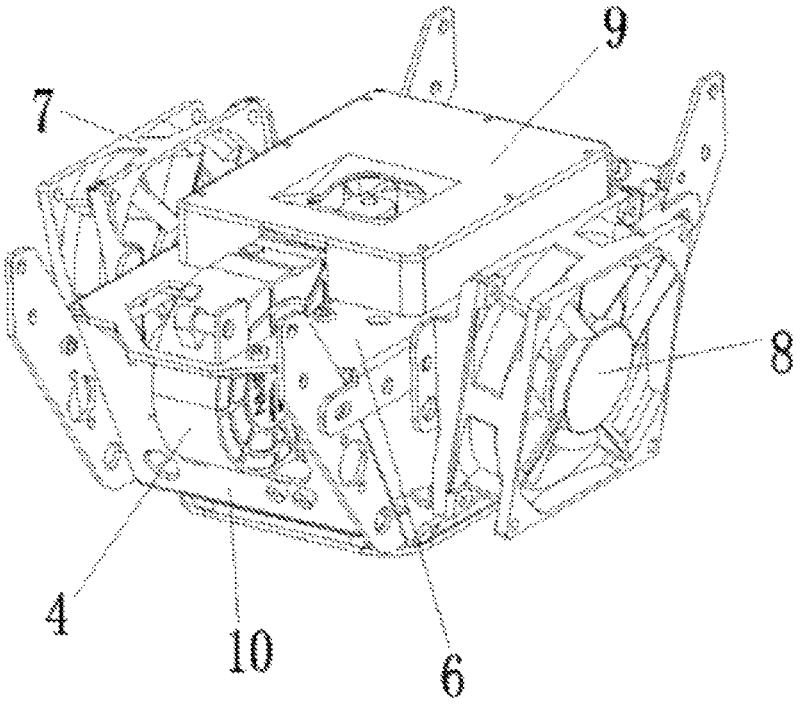
FIG. 1 is an overall schematic view of the present invention.

The drawings are only for illustrative purposes and should not be construed as a limit to the patent. In order to better illustrate the embodiments, some parts in the drawings may be omitted, enlarged or reduced, and the sizes do not represent the actual sizes of the products. For those skilled in the art, it will be understood that some known structures in the drawings and descriptions thereof are omitted. The positional relationships described in the drawings are for illustrative purposes only and are not intended to limit the present patent.

Embodiment 1

Figure 2:
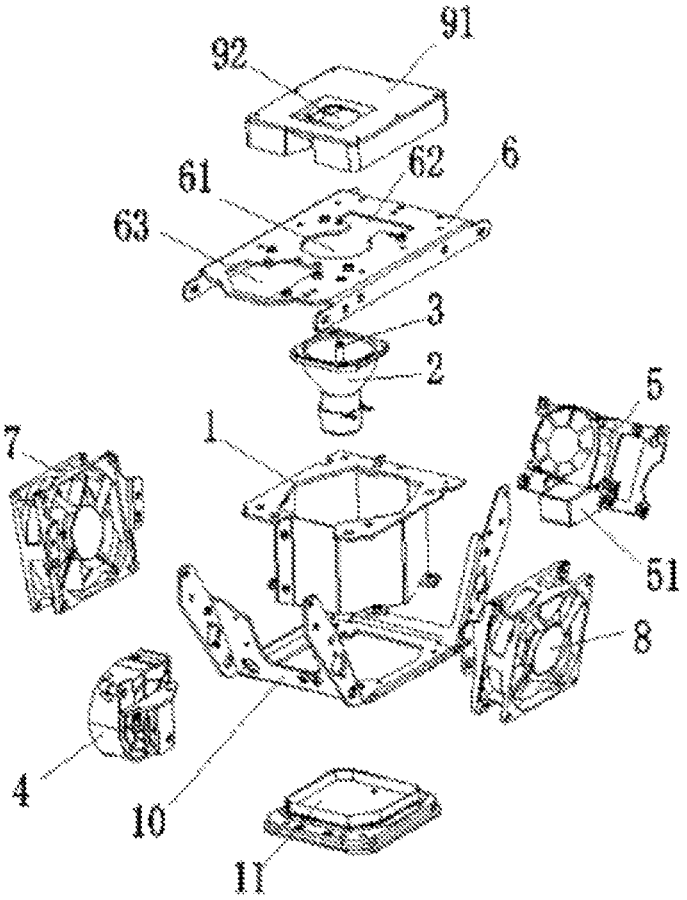
FIG. 2 is an exploded view of FIG. 1.

FIGS. 1 and 2 show a thermal system for a stage light source module including a lamp chamber 1 for housing a light source 3 and a light condenser 2 provided in the lamp chamber 1. Light emitted from the light source 3 is converged into a light beam by the light condenser 2 and the light beam defines a main optical axis. The lamp chamber 1 is of a hollow columnar structure defined by six side walls. The hollow column with six side walls is simple in structure and manufacturing process, in meet the cooling effect without impacting installation of other components.

As shown in FIGS. 1 and 2, a support plate 6 is provided above the lamp chamber 1, and a heat-shield assembly 9 is provided above the support plate 6. The heat-shield assembly 9 is arranged in form of a rectangular box with an opening at a bottom side thereof and defines a heat dissipation chamber together with the support plate 6. The support plate 6 is provided with a first through hole 61 which is closely fitted with the opening at an end of the light condenser 2. The thermal system further includes a first air blowing device 4. An air outlet of the first air blowing device 4 is connected to the heat dissipation chamber and faces the light condenser 2, so that forcing air flow blown from the first air blowing device 4 spreads to the inside of light condenser 2, thus cooling the inside of the light condenser and the light source 3. The support plate 6 is further provided with a second through hole 62 through which the lamp chamber 1 is connected to the heat dissipation chamber. After the forcing air flow, i.e. cold air, from the first air blowing device 4 is blown into the heat dissipation chamber and spreads to the inside of the light condenser 2 and the light source 3, the cold air becomes heat air, the heat air enters the inside of the lamp chamber 1 through the second through hole 62 and spreads to the outside of the light condenser 2 to cool the outside of the light condenser 2, and finally the heat air is discharged from the bottom of the lamp chamber 1. The first through hole 61 and the second through hole 62 can be connected or independent from each other.

As shown in FIG. 2, the first air blowing device 4 is provided below the support plate 6, and the support plate 6 is provided with a third through hole 63 through which at least a part of components of the first air blowing device 4 passes.

As shown in FIG. 2, the heat-shield assembly 9 includes a heat-shield frame 91 and a filter 92 provided on the heat-shield frame 91 and inclined with respect to the main optical axis at an angle within the range of 0-90°. With such configuration, only a small part of light is reflected back to the light source 3 by the filter 92 when the light passes through the filter 92, which contributes to the heat dissipation of the light source 3.

As shown in FIG. 2, a second air blowing device 5 is provided outside the lamp chamber 1, and the second blowing device 5 is provided with an air-guiding member 51 which is connected to the lamp chamber 1 through a fourth through hole provided in a side wall of the lamp chamber 1. An air outlet of the air-guiding member 51 faces the outside of the light condenser 2, so that the air flow blown from the second air blowing device 5 joins the air flow, which enters the lamp chamber 1 from the heat dissipation chamber, and spread around the light condenser 2, thus cooling the outside of the light condenser 2.

As shown in FIG. 2, the thermal system further includes a support frame 10, and the lamp chamber 1 is fixed inside the support frame 10. An air outlet in the form of blinds 11 is provided at a lower end of the lamp chamber 1, and the forcing air flow blown into the lamp chamber by the first air blowing device 4 and the second air blowing device 5 is discharged from the air outlet in the form of blinds 11 at the lower end of the lamp chamber 1. A third air blowing device 7 is provided on the support frame 10, and the air-out direction of the third air blowing device 7 is directed to the upper part of the lamp chamber 1. The air outlet of the third air blowing device 7 faces an edge of the hollow column of the lamp chamber 1, and an angle between the surface of the air outlet of the third air blowing device 7 and the main optical axis is 10°. With such configuration, the forcing air flow generated by the third air blowing device 7 spreads along two side walls defining the edge so as to mainly cool the components around the light source module, and meanwhile components above the light source 3 in a direction of the main optical axis can also be cooled.

As shown in FIG. 2, the thermal system further includes a fourth air blowing device 8 provided on an opposite side of the third air blowing device 7 with respect to the lamp chamber 1. An air outlet of the fourth air blowing device 8 faces another edge of the hollow column of the lamp chamber 1, and an angle between the surface of the air outlet of the fourth air blowing device 8, and the main optical axis is 10°. Similarly, with such configuration, the forcing air flow generated by the fourth air blowing device 8 spreads along two side walls defining the edge so as to mainly cool the components around the light source module, and meanwhile the components above the light source 3 in a direction of the main optical axis can also be cooled.

A comparative experiment of the inside temperature of a stage lighting fixture in prior art, i.e. the lamp chamber thereof is defined by four side walls and the inside temperature of a stage lighting fixture according to the present embodiment, i.e. the lamp chamber thereof is defined by six side walls, will be carried out by a method of controlling variables. The comparative experiment is that in the same condition three stage lighting fixtures are selected randomly from those in prior art and from those according to the embodiment respectively, the same thermal test points are provided on each stage lighting fixture, then the stage lighting fixtures operate at room temperature, temperature data is read and recorded at regular intervals, and the data of each three stage lighting fixtures is averaged as an experimental result.

The temperature data of the stage lighting fixtures in prior art recorded at different time periods is shown in the following table:

| Thermal Test Point | Test Item | 5 Mins | 20 Mins | 40 Mins | 60 Mins | 80 Mins | 100 Mins | 150 Mins |
|---|---|---|---|---|---|---|---|---|
| First air blowing device | Temperature/° C. | 56 | 77 | 76 | 78 | 85 | 88 | 87 |
| Second air blowing device | Temperature/° C. | 59 | 76 | 78 | 82 | 88 | 89 | 88 |
| Third air blowing device | Temperature/° C. | 56 | 70 | 75 | 76 | 79 | 82 | 83 |
| Fourth air blowing device | Temperature/° C. | 56 | 88 | 95 | 98 | 98 | 101 | 102 |
| Motor | Temperature/° C. | 44 | 57 | 63 | 68 | 76 | 77 | 77 |
| Thermal protector | Temperature/° C. | 75 | 99 | 98 | 99 | 109 | 112 | 115 |

The temperature data of the stage lighting fixtures according to the embodiment recorded at different time periods is shown in the following table:

| Thermal Test Point | Test Item | 5 Mins | 20 Mins | 40 Mins | 60 Mins | 80 Mins | 100 Mins | 150 Mins |
|---|---|---|---|---|---|---|---|---|
| First air blowing device | Temperature/° C. | 43 | 62 | 65 | 66 | 67 | 67 | 67 |
| Second air blowing device | Temperature/° C. | 50 | 69 | 69 | 69 | 70 | 70 | 70 |
| Third air blowing device | Temperature/° C. | 47 | 63 | 63 | 64 | 64 | 64 | 63 |
| Fourth air blowing device | Temperature/° C. | 52 | 76 | 77 | 78 | 78 | 78 | 77 |
| Motor | Temperature/° C. | 41 | 48 | 60 | 64 | 65 | 67 | 67 |
| Thermal protector | Temperature/° C. | 67 | 92 | 94 | 96 | 96 | 97 | 97 |

The comparison between the temperature data in the above two tables shows that the temperature of each component in the stage lighting fixtures in prior art is higher than that of the stage lighting fixtures according to the embodiment. Usually, a nominal temperature of an air blowing device is 75° C., and a fan assembly can be burnt out when it operates above the nominal temperature for a long period of time, which is detrimental to system stability and reliability. According to the technical scheme of the embodiment, shape change of the lamp chamber together with installation directions change of the third air blowing device and the fourth air blowing device allow a good cooling effect of each component, thus improving the system stability and reliability.

Embodiment 2

The second embodiment is similar to the first embodiment except that the lamp chamber 1 of this embodiment is of a hollow columnar structure defined by 10 side walls. The operation principle of this embodiment is same as that of the first embodiment.

Embodiment 3

The third embodiment is similar to the first embodiment except that the lamp chamber 1 of this embodiment is of a hollow columnar structure defined by 100 side walls. The operation principle of this embodiment is same as that of the first embodiment.

Embodiment 4

The fourth embodiment is similar to the first embodiment except that the lamp chamber 1 of this embodiment is of a hollow cylindrical structure. The operation principle of this embodiment is same as that of the first embodiment.

Embodiment 5

The fourth embodiment is similar to the first embodiment except that the lamp chamber 1 of this embodiment is of a hollow elliptic cylindrical structure. The operation principle of this embodiment is same as that of the first embodiment.

Obviously, the above embodiments of the present invention are merely examples for clear illustration and are not intended to limit the embodiments of the present invention. For those skilled in the art, other modifications or changes can be made on the basis of the above description. There is no need and no exhaustion for all implementations. Any modification, equivalent substitution or improvement, or the like within the spirit and principles of the present invention shall be within the scope of claims of the present invention.

The invention claimed is:

1. A thermal system for a stage light source module, comprising:

a lamp chamber for housing a light source; and a light condenser which is provided in the lamp chamber and by which light emitted from the light source is converged into a light beam defining a main optical axis, wherein the lamp chamber is of a hollow columnar structure defined by at least five lateral side walls, or of a hollow cylindrical structure, or of a hollow elliptic cylindrical structure;

wherein further comprising a heat dissipation chamber above the lamp chamber, the heat dissipation chamber has a first through hole and a second through hole, the first through hole is closely fitted to an opening at an end of the light condenser, and the lamp chamber communicates with the heat dissipation chamber through the second through hole;

wherein further comprising a first air blowing device, an air outlet of the first air blowing device is connected to the heat dissipation chamber and faces towards the light condenser; and wherein air flows generated by the first air blowing device blow into the heat dissipation chamber and spread to an inside of the light condenser and the light source via the first through hole, then enter an inside of the lamp chamber via the second through hole and spread to an outside of the light condenser to cool the outside of the light condenser, and finally discharged from a bottom of the lamp chamber.

2. The thermal system for a stage light source module according to claim 1, wherein the lamp chamber is of a hollow columnar structure defined by 6 to 100 lateral side walls.

3. The thermal system for a stage light source module according to claim 1, wherein the heat dissipation chamber comprises a support plate and a heat-shield assembly, the support plate is provided above the lamp chamber; the heat-shield assembly is provided above the support plate; and the first through hole and the second through hole are provided on the support plate.

4. The thermal system for a stage light source module according to claim 3, wherein the first air blowing device is provided below the support plate; and the support plate is provided with a third through hole through which at least a part of components of the first air blowing device passes.

5. The thermal system for a stage light source module according to claim 3, wherein the heat-shield assembly includes a heat-shield frame and a filter provided on the heat-shield frame and inclined with respect to the main optical axis at an angle within the range of 0-90°.

6. The thermal system for a stage light source module according to claim 1, wherein a second air blowing device is arranged outside the lamp chamber and provided with an air-guiding member which is connected to the lamp chamber through a fourth through hole provided in a lateral side wall of the lamp chamber.

7. The thermal system for a stage light source module according to claim 1 further comprising:

a support frame, wherein the lamp chamber is fixed inside the support frame; an air outlet in the form of blinds is provided at a lower end of the lamp chamber; and a third air blowing device is provided on the support frame and the air-out direction of the third air blowing device is directed to the upper part of the lamp chamber.

8. The thermal system for a stage light source module according to claim 7, wherein the air outlet of the third air blowing device faces an edge of the hollow column of the lamp chamber.

9. The thermal system for a stage light source module according to claim 8 further comprising:

a fourth air blowing device, wherein the fourth air blowing device is provided on an opposite side of the third air blowing device with respect to the lamp chamber; an air outlet of the fourth air blowing device faces another edge of the hollow column of the lamp chamber; and an angle between the surface of the air outlet of the fourth air blowing device and the main optical axis is formed in a range from 10° to 60°.

10. The thermal system for a stage light source module according to claim 7, wherein an angle between the surface of the air outlet of the third air blowing device and the main optical axis is formed in a range from 10° to 60°.

* * * * *